US007344461B2

(12) United States Patent
Van Nguyen

(10) Patent No.: US 7,344,461 B2
(45) Date of Patent: Mar. 18, 2008

(54) COMPOSITE BAT WITH METAL SLEEVE

(76) Inventor: Thu Van Nguyen, 24128 Hillhurst Dr., West Hills, CA (US) 91307

( * ) Notice: Subject to any disclaimer, the term of this patent is extended or adjusted under 35 U.S.C. 154(b) by 0 days.

(21) Appl. No.: 11/307,892

(22) Filed: Feb. 27, 2006

(65) Prior Publication Data

US 2007/0202973 A1 Aug. 30, 2007

(51) Int. Cl.
*A63B 59/06* (2006.01)

(52) U.S. Cl. ..... 473/567; 473/566

(58) Field of Classification Search ..... 473/564–568, 473/457, 519, 520

See application file for complete search history.

(56) References Cited

U.S. PATENT DOCUMENTS

| | | | | |
|---|---|---|---|---|
| 3,877,698 | A | 4/1975 | Volpe | |
| 4,025,377 | A | 5/1977 | Tanikawa | |
| 5,409,214 | A | 4/1995 | Cook | |
| 5,593,158 | A | 1/1997 | Filice et al. | |
| 5,695,419 | A * | 12/1997 | Haringa | 473/564 |
| 5,722,908 | A | 3/1998 | Feeney et al. | |
| 6,042,493 | A | 3/2000 | Chauvin et al. | |
| 6,053,828 | A * | 4/2000 | Pitsenberger | 473/566 |
| 6,056,655 | A | 5/2000 | Fenney et al. | |
| 6,159,116 | A * | 12/2000 | Pitsenberger | 473/566 |
| 6,398,675 | B1 * | 6/2002 | Eggiman et al. | 473/566 |
| 6,432,006 | B1 | 8/2002 | Tribble | |
| 6,440,017 | B1 * | 8/2002 | Anderson | 473/566 |
| 6,482,114 | B1 * | 11/2002 | Eggiman et al. | 473/566 |
| 6,485,382 | B1 | 11/2002 | Chen | |
| 6,511,392 | B1 | 1/2003 | Chohan | |
| D476,709 | S | 7/2003 | Nguyen | |
| 6,702,698 | B2 | 3/2004 | Eggiman et al. | |
| 6,761,653 | B1 * | 7/2004 | Higginbotham et al. | 473/566 |
| 6,808,464 | B1 | 10/2004 | Nguyen | |
| 6,997,826 | B2 * | 2/2006 | Sutherland | 473/567 |
| 2001/0034277 | A1 * | 10/2001 | Haringa | 473/457 |
| 2002/0183142 | A1 * | 12/2002 | Higginbotham | 473/564 |
| 2003/0153416 | A1 * | 8/2003 | Anderson | 473/566 |
| 2006/0258490 | A1 * | 11/2006 | Fitzgerald et al. | 473/564 |

FOREIGN PATENT DOCUMENTS

| | | | |
|---|---|---|---|
| JP | 2004113557 A | * | 4/2004 |
| JP | 2005218567 A | * | 8/2005 |

* cited by examiner

*Primary Examiner*—Mark S Graham
(74) *Attorney, Agent, or Firm*—Kelly Lowry & Kelley LLP

(57) ABSTRACT

A baseball bat has a composite bat body including a grip, a handle and a barrel extending from the handle. The baseball bat also includes a generally tubular, resilient sleeve having greater impact absorption and resistance characteristics than the composite bat body. The sleeve is disposed adjacent to an exterior of the barrel of the bat body. The baseball bat further includes a mechanism for interconnecting the bat body and sleeve in a coaxial relation such that a portion of the bat body overlaps the sleeve.

11 Claims, 3 Drawing Sheets

COMPOSITE BAT WITH METAL SLEEVE

BACKGROUND OF THE INVENTION

The present invention relates to baseball and softball bats. More particularly, the present invention relates to a composite bat having a metal sleeve.

Baseball and softball are very popular sports in the United States, Mexico, Cuba, Japan and elsewhere. Due to the competitive nature of the sports, players are constantly seeking ways of improving their performance. An important aspect of baseball and softball is the ability to effectively hit the ball. Aluminum (metal) bats are allowed in baseball amateur play from Little League to College levels. Metal bats are also typically used in slow and fast pitch softball. Such bats are advantageous over wood bats in that they do not break and splinter like wood bats and thus can be repeatedly used with consequent cost savings. Metal bats also have a larger optimal hitting area or power zone (commonly referred to as the "sweet spot") than wood bats. Furthermore, the ball comes off a metal bat faster than a wood bat resulting in longer hits.

However, metal bats have certain disadvantages. Metal bats vibrate upon impact and may send painful vibrations into the hands and arms of the batter if the ball is not hit within the power zone of the bat. Metal bats, particularly aluminum bats, may also dent or otherwise deform due to forceful impacts with the ball. Metal bats also emit an undesirable high-pitched metallic sound, as opposed to the traditional sound heard when a wood bat contacts the ball.

Various attempts have been made to overcome the problems associated with metal bats. Some attempts have been to coat or wrap the exterior of the metal bat with materials such as carbon reinforcing fibers to enhance batting performance. These externally wrapped bats have been found to be aesthetically unpleasant and lacking in significant improvement. Other attempts have been made to insert internal layers or compartments within the metal bat to improve performance. Bats have been devised that incorporate both metal and composite materials. Such designs include utilizing multiple-layered graphite inserts to provide durability and flexibility to the bat, tubular coiled spring steel inserts to improve the spring-board effect when the ball contacts the bat, and pressurized air chambers within the bat. Bats that incorporate composite materials tend to be much lighter than metal bats. While providing benefits, these designs also have drawbacks. Some designs are very expensive to manufacture and are prone to structural failure. The composite sheaths break down over time, the bats are subject to premature longitudinal cracks in the barrel of the bat and damage is created at an interface of the metal and composite materials due to differences in the impact absorption and resistance characteristics of the materials.

Accordingly, there is a need for a bat which enhances the performance of the bat and overcomes the disadvantages previously experienced with metal bats. The present invention fulfills these needs and provides other related advantages.

SUMMARY OF THE INVENTION

The present invention resides in a baseball bat having a composite bat body including a grip, a handle and a barrel extending from the handle. The baseball bat also includes a generally tubular, resilient sleeve having greater impact absorption and resistance characteristics than the composite bat body. The sleeve is disposed adjacent to an exterior of the barrel of the bat body. The baseball bat further includes a mechanism for interconnecting the bat body and sleeve in a coaxial relation such that a portion of the bat body overlaps the sleeve.

In one embodiment, the interconnecting mechanism of the baseball bat includes an annular recess disposed at an end of the barrel of the bat body, for receiving an end of the sleeve therein. The end of the sleeve tapers inwardly for engagement with the annular recess. The interconnecting mechanism also includes a cylindrical recess along the barrel of the bat body for receiving the sleeve therein. The barrel of the bat body includes a maximum exterior diameter surface generally equal to a maximum exterior diameter surface of the sleeve for providing a generally continuous exterior surface of the baseball bat when the sleeve engages the barrel of the bat body. The barrel of the bat body also includes a minimum exterior diameter surface generally equal to a minimum interior diameter surface of the sleeve for providing friction-fit engagement of the sleeve and the barrel of the bat body. The interconnecting mechanism additionally includes first and second aligned, oppositely disposed ends of the sleeve, tapering inwardly for engaging the barrel of the bat body, wherein a section of the barrel of the bat body overlaps and envelops the end of the sleeve engaging the annular recess.

The baseball bat also includes a cap disposed on an end of the barrel of the bat body.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
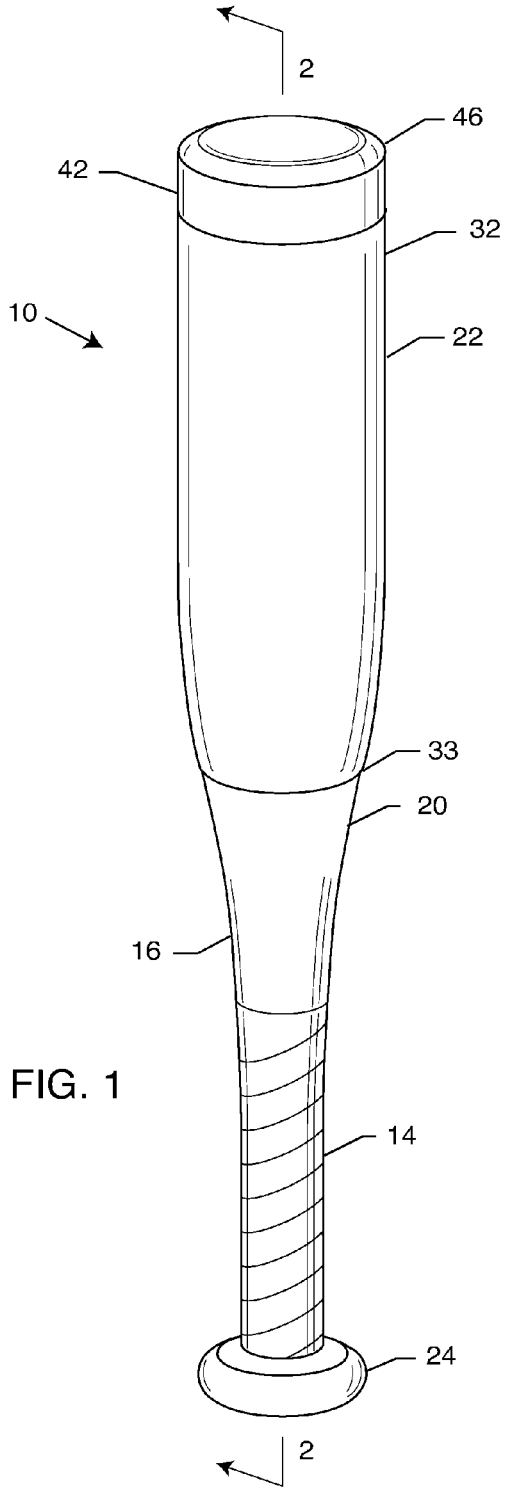
FIG. 1 is a perspective view of a baseball bat embodying the present invention.

As shown in FIGS. 1-6 for purposes of illustration, the present invention is concerned with a bat 10 for use in baseball or softball. The bat 10 includes a bat body 12 that has a grip 14, an elongate hollow cylindrical handle 16 and an elongate hollow cylindrical barrel 18 extending from the handle 16. There is an intermediate cylindrically tapered section 20 interconnecting the handle 16 and the barrel 18. The bat body 12 is preferably made from a composite material (e.g., fiberglass, carbon fibers, or a combination of glass and carbon fibers (50/50 glass to carbon, 80/20 glass to carbon for a very flexible bat, 20/80 glass to carbon for a very stiff bat or any other ratio of glass to fiber in order to obtain a desired flex in the bat 10)). The baseball bat 10 also includes a generally tubular, hollow, resilient sleeve 22 having greater impact absorption and resistance characteristics than the composite bat body 12. The sleeve 22 is disposed adjacent to an exterior of the barrel 18 of the bat body 12. In the alternative, the bat body 12 may be made from various materials that include, without limitation, wood, a lightweight yet durable metal (e.g., aluminum, titanium, magnesium, or an alloy thereof) having lesser impact absorption and resistance characteristics than the material forming the sleeve 22. The sleeve 22 and the bat body 12 form a generally continuous external surface of the bat 10.

The sleeve 22 is made from a resilient material that includes, without limitation, metal (e.g., an aluminum alloy), a composite material (e.g., fiberglass, carbon fibers, or a combination of glass and carbon fibers) having greater impact absorption and resistance characteristics than the composite material forming the bat body 12 or the like. Preferably, the sleeve is comprised of a 6000 or 7000 series aluminum alloy in which zinc is the major alloying element coupled with a smaller percentage of magnesium, resulting in a heat-treatable alloy of very high strength. The sleeve 22 is finished to a mechanical strength of T6/T7 Temper.

A knob 24 is securely attached to the end of the handle 16 by a variety of means, including, without limitation, bonding agents, glues, adhesives, or the like. The knob 24 may be made of various materials including, without limitation, aluminum, polyurethane, polycarbonate, a composite material, Zytel, Delrin, plastic or the like. Also, the handle 16 is typically wrapped with the grip 14 (comprised of rubber, polyurethane, leather or the like) for comfort.

The baseball 10 bat further includes a mechanism 26 for interconnecting the bat body 12 and the sleeve 22 in a coaxial relation with respect to one another. The interconnecting mechanism 26 includes a cylindrical recess 28 longitudinally coaxial along the barrel 18 of the bat body 12 for receiving the sleeve 22 therein. An annular recess 30 is disposed at an end of the cylindrical recess 28 of the barrel 18 of the bat body 12, for receiving an aligned disposed end 32 of the sleeve 22 therein. The end 32 of the sleeve 22 curls or tapers inwardly for engagement with the annular recess 30 of the barrel 18. An opposite aligned end 33 of the sleeve 22 is cylindrically tapered to match the taper of the barrel 18 and the intermediate section 20. The end 33 is rounded and tapers inwardly.

The barrel 18 of the bat body 12 includes a maximum exterior diameter surface 34 generally equal to a maximum exterior diameter surface 36 of the sleeve 22 for providing a generally continuous exterior surface of the bat 10 when the sleeve 22 engages the barrel 18 of the bat body 12. The barrel 18 of the bat body 12 also includes a minimum exterior diameter surface 38 generally equal to a minimum interior diameter surface 40 of the sleeve 22 for providing friction-fit engagement of the sleeve 22 and the barrel 18 of the bat body 12. This provides a generally continuous taper between the exterior surface of the sleeve 22 and the exterior surface of the intermediate tapered section 20 as well as between the exterior surface of the sleeve 22 and an end 42 of the barrel 18.

As outlined above, the end 32 of the sleeve 22 tapers inwardly for engaging the annular recess 30 of the barrel 18 of the bat body 12. This allows an annular extension section 44 of the barrel 18 of the bat body 12 to overlap and envelop the end 32 of the sleeve 22 when engaged therewith. The annular recess 30 of the barrel 18 is defined between the barrel section 44 and the cylindrical recess 28 of the barrel 18.

The end 32 of the sleeve 22 abuttingly engages the annular recess 30 of the barrel 18 when the annular recess 30 receives the end 32 of the sleeve 22. The length of the intermediate tapered section 20 and the entire bat body 12 will be varied based on the size and type of bat (e.g., adult baseball bat, youth baseball bat, softball bat or the like).

The bat 10 also includes an end plug or cap 46 disposed on the end 42 of the barrel 18 of the bat body 12. In one embodiment, the cap 46 is formed of a composite material and of single piece construction with the barrel 18 of the bat body 12. In an alternative, the end 42 of the barrel 18 may be open and directed inward for acceptance and retention of a separate cap 46. The cap 46 could be comprised of a composite material, urethane, polyurethane, Zytel or the like. The cap 46 would have a circumferential groove (not shown) which accepts an inwardly directed annular lip (not shown) of the barrel 18. The annular recess 30 could be formed by the cap 46 engaging the end 42 of the barrel 18.

Figure 2:
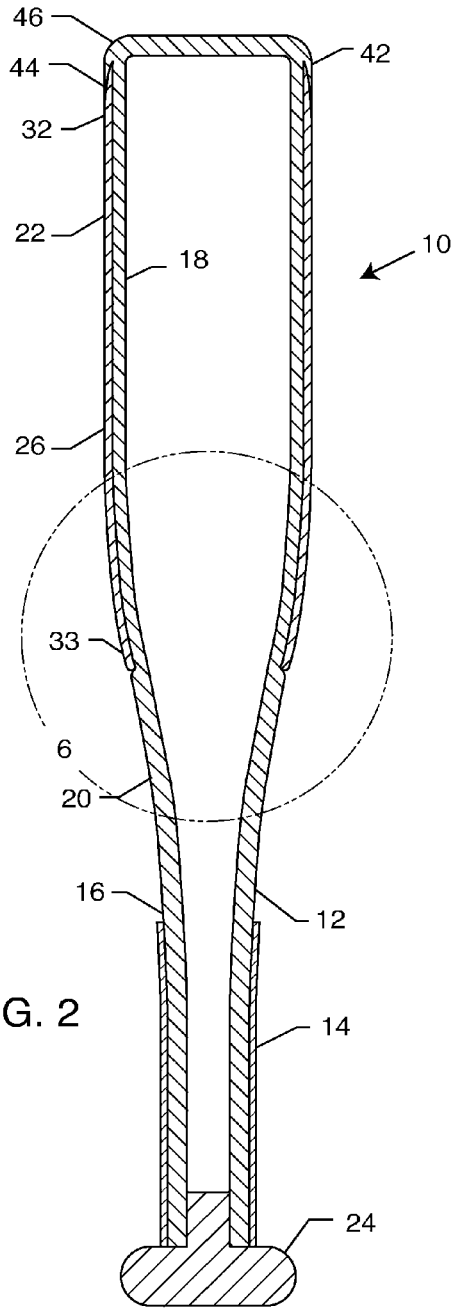
FIG. 2 is a cross-sectional view taken generally along the line 2-2 of FIG. 1, showing a bat body, sleeve, and mechanism for interconnecting the bat body and the sleeve.
Figure 3:
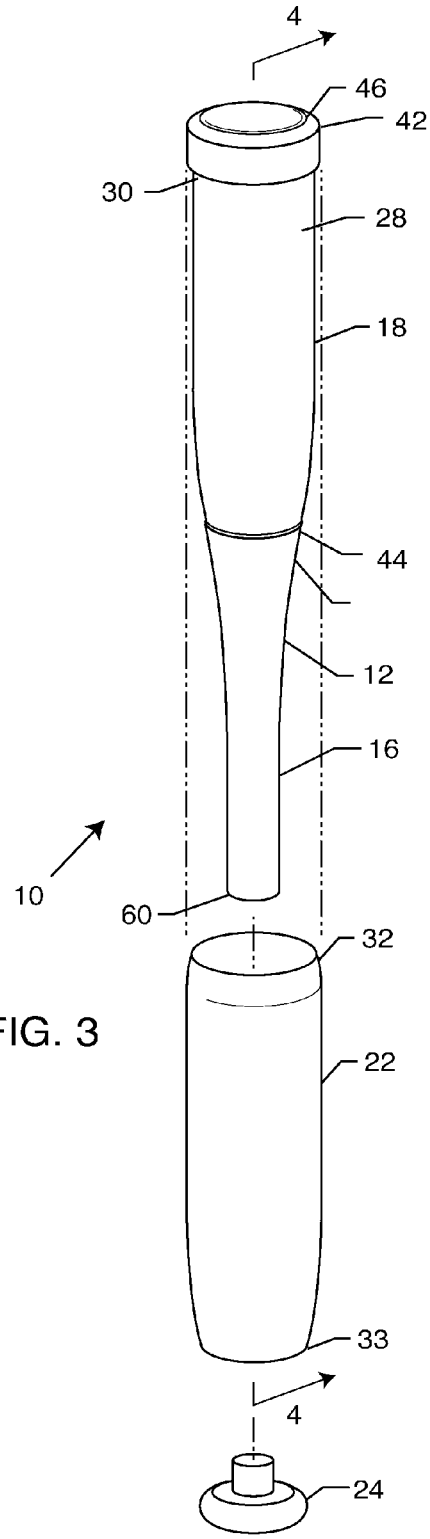
FIG. 3 is an exploded perspective view of the bat body, sleeve, and interconnecting mechanism of the baseball bat of FIGS. 1 and 2.
Figure 4:
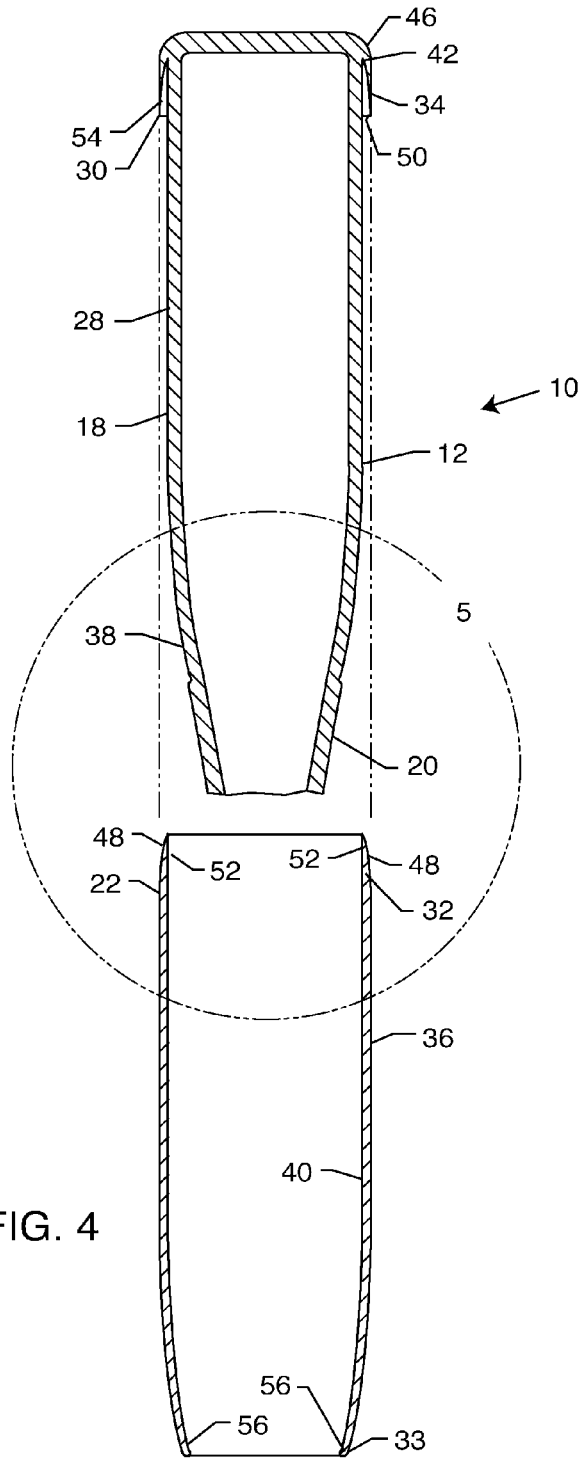
FIG. 4 is an exploded, cross-sectional view taken generally along the line 4-4 of FIG. 3.
Figure 5:
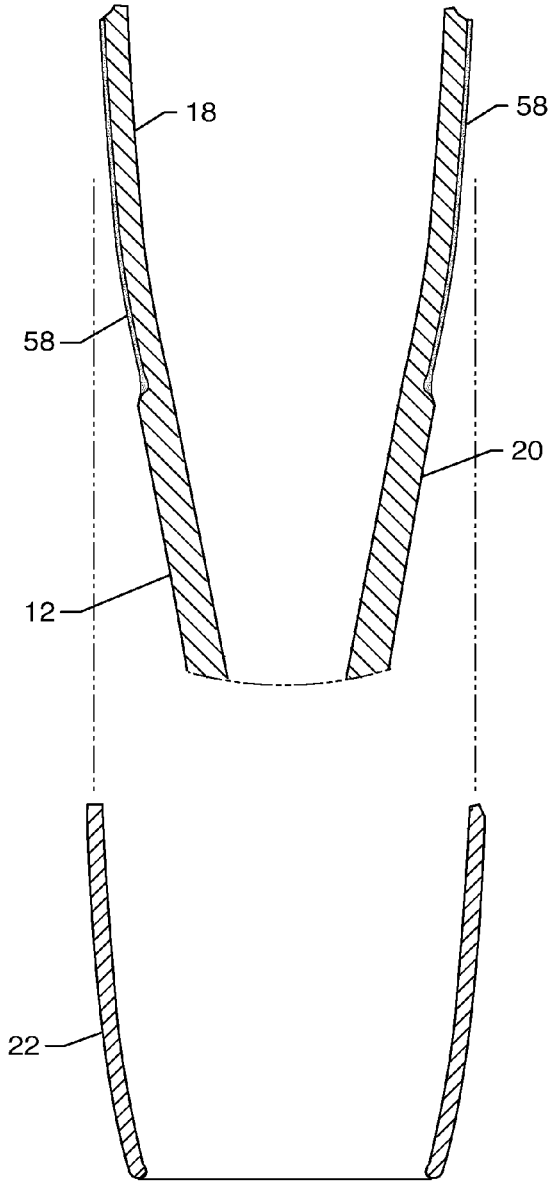
FIG. 5 is an enlarged view of area 5 of FIG. 4.
Figure 6:
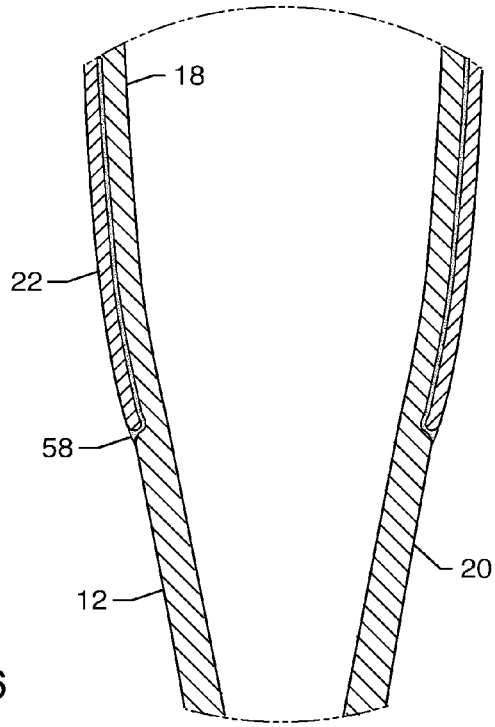
FIG. 6 is an enlarged view of area 6 of FIG. 2.

In general, the angle of the end 32 of the sleeve 22 matches the angle of the annular recess 30; the angle of the end 32 being between zero and forty-five degrees. More particularly, the angle of an exterior surface 48 of the end 32 of the sleeve 22 matches the angle of a first shoulder 50 of the annular recess 30; the angle of the first shoulder 50 being between zero and forty-five degrees. The angle of an interior surface 52 of the end 32 of the sleeve 22 matches the angle of a second shoulder 54 of the annular recess 30; the angle of the second shoulder 54 being between zero and forty-five degrees. The angles of the exterior and interior surfaces 48, 52 (along with their respective shoulders 50, 54) of the end 32 of the sleeve 22 may differ from the other end 33 of the sleeve 22. For example, as seen in FIGS. 2 and 4, the angle of the interior surface 52 of the end 32 of the sleeve nearest the cap 46 is different from the angle of an interior surface 56 of the sleeve 22 nearest the intermediate tapered section 20. As a ball makes contact with and impacts the sleeve 22, the engagement of the end 32 of the sleeve 22 with the annular recess 30 allows the section 44 of the barrel 18 of the bat body 12 that overlaps and envelops the end 32 of the sleeve 22 to flex with the end 32 of the sleeve 22.

A layer of glue, adhesive, bonding agent or the like 58 is disposed between the interior surface 40 of the sleeve 22. The glue, adhesive or bonding agent may be applied to all joints to secure all the connections. The glue, adhesive or bonding agent helps to dampen vibrations, fill in gaps and allow additional flexibility. The glue 58 provides a flexible cushion along the interface of the sleeve 22 and the bat body 12.

The bat 10 may be assembled in a number of ways. It is to be understood that the following methods may be altered in some respects while still creating a bat 10 having the desired characteristics. Also, certain dimensions, materials, temperatures, etc. may be altered depending upon the size, weight and intended use of the resulting bat 10, such as for softball, baseball or the like.

In one particular method of construction, the bat body 12 is made of single-piece construction from a composite material to form the bat body 12 described above. An end of the handle 16 is inserted through the open end 32 of the sleeve 22 until the sleeve 22 engages the cylindrical recess 28 of the barrel 18 and the end 32 of the sleeve 22 engages the annular recess 30 of the barrel 18. The glue, adhesive or bonding agent 58 connects the sleeve 22 to the bat body 12. In the alternative, the composite bat body 12 may be formed around the sleeve 22 itself.

The composite material bat body 12 may be manufactured using a variety of techniques. These techniques include, but are not limited to: resin transfer molding (RTM); vacuum resin transfer molding (VRTM); filament winding and wrapping technique. Using RTM, various layers of the composite material are premanufactured to form the bat body 12. Wrapping technique provides a layer-by-layer formation of the bat body 12 that allows the manufacturer to control the flexibility of the bat body 12. In general, the bat body 12 is formed by approximately sixteen to twenty layers of composite material, depending on fiber type, fiber thicknesss (0.001-0.003 inches), fiber area weight (FAW), and flex. The sleeve 22 may be manufactured by a variety of conventional techniques. In particular, the sleeve 22 is formed from an aluminum tube that is swaged to shape, heat treated, and aged. The interior of the ends 32, 33 is then machined to closely engage the recess 28. During the aging process, the sleeve 22 achieves an underage T7 Temper. After the sleeve 22 is glued to the recess 28, the aging process is continued with the sleeve 22 in order to achieve an overage T7 Temper. In the alternative, the bat body 12 and the sleeve 22 may both be made of composite materials (of equal or differing hardness) or metal (of equal or differing hardness). In another alternative, the sleeve 22 may be made of a composite material, such as those described above, and the bat body 12 may be made of a metal, such as those described above.

The bat 10 is completed by attaching the knob 24 typically by gluing the knob 24 to an open end 60 of the handle 16. The grip 14 and the end plug 46 (if a separate component from the bat body 12) are then installed to finish the bat 10.

The interconnection of the sleeve 22 and the bat body 12 improves the ability of the bat 10 to absorb impacts when the ball contacts the bat 10 by allowing the section 44 of the barrel 18 of the bat 10 to flex along with the end 32 of the sleeve 22 upon impact and then springs back to its original shape. The width and depth of the cylindrical recess 28 and the annular recess 30 (along with the dimensions of the sleeve 22) can be varied to obtain the ultimate performance of the bat 10, depending on the design of the bat 10. The diameters and thicknesses of the handle 16, barrel 18 and intermediate section 20 can be varied to alter the characteristics and performance of the bat 10. Various physical characteristics of the bat 10, such as the length, wall thickness or diameter may be increased or decreased.

The bat 10 may be decorated by any appropriate method. For example, the external surface of the bat body 12 may be painted, chromed, powder-coated, or covered by some other method of decorative coating. The outer surface of the bat body 12 may be decorated with a graphic by using various methods such as silkscreening, heat transferring, or pad stamping.

Although constructed from affordable medium to high strength, light weight, and commercially available materials, the bat 10 of the present invention offers the performance and advantages of expensive and high strength materials. The bat 10 provides improved dent resistance. Premature longitudinal cracking of the barrel 18, caused in traditional bats with thin wall thicknesses and high stress conditions, is avoided in the present invention.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A baseball bat, comprising:

a composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body; and means for interconnecting the bat body and sleeve in a coaxial relation wherein a portion of the bat body overlaps the sleeve;

wherein the interconnecting means comprises a generally cylindrical recess along the barrel of the bat body for receiving the sleeve therein; and wherein the barrel of the bat body includes a maximum exterior diameter surface generally equal to a maximum exterior diameter surface of the sleeve, for providing a generally continuous exterior surface of the baseball bat when the sleeve is disposed adjacent to the barrel of the bat body.

2. The baseball bat of claim 1, wherein the barrel of the bat body includes a minimum exterior diameter surface generally equal to a minimum interior diameter surface of the sleeve for providing friction-fit engagement of the sleeve and the barrel of the bat body.

3. A baseball bat, comprising:

a composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body; and means for interconnecting the bat body and sleeve in a coaxial relation wherein a portion of the bat body overlaps the sleeve;

wherein the interconnecting means includes first and second aligned, oppositely disposed ends of the sleeve, tapering inwardly for engaging the barrel of the bat body, wherein a section of the barrel of the bat body overlaps and envelops one of the ends of the sleeve.

4. A baseball bat, comprising:

a composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body; and means for interconnecting the bat body and sleeve in a coaxial relation wherein a portion of the bat body overlaps the sleeve;

wherein the interconnecting means includes a section of the barrel of the bat body overlapping and enveloping an end of the sleeve.

5. The baseball bat of claim 4, including a cap disposed on an end of the barrel of the bat body.

6. A baseball bat, comprising:

a composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body; and means for interconnecting the bat body and sleeve in a coaxial relation comprising a cylindrical recess along the barrel of the bat body for receiving the sleeve therein and an annular recess disposed on an end of the cylindrical recess of the barrel of the bat body, for receiving an end of the sleeve therein;

wherein the barrel of the bat body includes a maximum exterior diameter surface generally equal to a maximum exterior diameter surface of the sleeve, for providing a generally continuous exterior surface of the baseball bat when the sleeve is disposed adjacent to the barrel of the bat body.

7. The baseball bat of claim 6, wherein the end of the sleeve tapers inwardly for engagement with the annular recess.

8. The baseball bat of claim 6, wherein the barrel of the bat body includes a minimum exterior diameter surface generally equal to a minimum interior diameter surface of the sleeve for providing friction-fit engagement of the sleeve and the barrel of the bat body.

9. A baseball bat, comprising:

an composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body; and means for interconnecting the bat body and sleeve in a coaxial relation comprising a cylindrical recess along he barrel of the bat body for receiving the sleeve therein and an annular recess disposed on an end of the cylindrical recess of the barrel of the bat body for receiving an end of the sleeve therein;

wherein the interconnecting means includes first and second aligned, oppositely disposed ends of the sleeve, at least one of the ends of the sleeve tapering inwardly for engaging the annular recess of the barrel of the bat body, wherein a section of the barrel of the bat body overlaps and envelops the end of the sleeve encasing the annular recess.

10. The baseball bat of claim 9, including a cap disposed on an end of the barrel of the bat body.

11. A baseball bat, comprising:

a composite bat body including a grip, a handle and a barrel extending from the handle;

a generally tubular, resilient sleeve having greater impact absorption and resistance characteristics than the composite bat body, the sleeve being disposed adjacent to an exterior of the barrel of the bat body;

means for interconnecting the bat body and sleeve in a coaxial relation comprising a cylindrical recess along the barrel of the bat body for receiving the sleeve therein and an annular recess disposed at an end of the cylindrical recess of the barrel of the bat body, for receiving therein one of the ends of the sleeve that tapers inwardly for engagement with the annular recess of the barrel of the bat body, and a section of the barrel of the bat body that overlaps and envelops the end of the sleeve that engages the annular recess of the barrel of the bat body; and a cap disposed on an end of the barrel of the bat body;

wherein the barrel of the bat body includes a maximum exterior diameter surface generally equal to a maximum exterior diameter surface of the sleeve, for providing a generally continuous exterior surface of the baseball bat when the sleeve is disposed adjacent to the barrel of the bat body, and a minimum exterior diameter surface generally equal to a minimum interior diameter surface of the sleeve for providing friction-fit engagement of the sleeve and the barrel of the bat body.

* * * * *

UNITED STATES PATENT AND TRADEMARK OFFICE

CERTIFICATE OF CORRECTION

PATENT NO. : 7,344,461 B2
APPLICATION NO. : 11/307892
DATED : March 18, 2008
INVENTOR(S) : Thu Van Nguyen It is certified that error appears in the above-identified patent and that said Letters Patent is hereby corrected as shown below:

In Column 7, line 26, “he barrel” should read --the barrel--

Signed and Sealed this

Fifth Day of August, 2008

JON W. DUDAS
*Director of the United States Patent and Trademark Office*